US007322141B1

(12) United States Patent
Leung

(10) Patent No.: US 7,322,141 B1
(45) Date of Patent: Jan. 29, 2008

(54) ROTATING FORE GRIP FOR SMALL ARMS

(75) Inventor: Fee Chan Leung, Hazlet, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/288,067

(22) Filed: Nov. 23, 2005

Related U.S. Application Data

(63) Continuation-in-part of application No. 11/288,068, filed on Nov. 23, 2005, which is a continuation-in-part of application No. 11/288,064, filed on Nov. 23, 2005.

(51) Int. Cl.
*F41C 23/04* (2006.01)
*F41C 23/16* (2006.01)

(52) U.S. Cl. ..... 42/71.01; 42/73; 42/75.03

(58) Field of Classification Search ..... 42/71.01, 42/73, 75.03, 75.04
See application file for complete search history.

(56) References Cited

U.S. PATENT DOCUMENTS 3,369,316 A * 2/1968 Miller ..... 42/72
6,543,173 B1 * 4/2003 Golan ..... 42/75.04
6,598,329 B1 * 7/2003 Alexander ..... 42/71.01
6,901,691 B1 * 6/2005 Little ..... 42/118

* cited by examiner

*Primary Examiner*—Bret Hayes
(74) *Attorney, Agent, or Firm*—Michael Zelenka; George B. Tereschuk

(57) ABSTRACT

A firearm includes a barrel that has a central axis, a receiver fixedly supporting the barrel, a gunstock that is connected to the receiver and that comprises a longitudinal axis, and a shoulder stock extending in a plane that is generally perpendicular to the longitudinal axis of the gunstock. The gunstock and the receiver may each be configured to provide for angular movement of the gunstock relative to the receiver and, in turn, the barrel whereby the central axis of the barrel varies in a generally radial direction extending from the longitudinal axis of the gunstock. In this way, the firearm may be discharged by a warfighter, standing adjacent to a corner, around the corner.

7 Claims, 4 Drawing Sheets

ROTATING FORE GRIP FOR SMALL ARMS

CROSS REFERENCE TO RELATED APPLICATION

This application is a Continuation-In-Part of U.S. patent application Ser. No. 11/288,068 entitled "Rotating Fore Grip For Small Arms", filed on Nov. 23, 2005, by the same inventor and which, in turn, is a Continuation-In-Part of U.S. patent application Ser. No. 11/288,064, entitled "Rotating Hand Grip Trigger Assembly For Small Arms", filed on Nov. 23, 2005, by the same inventor. This Continuation-In-Part is being filed under 37 CFR. § 1.53 and priority from the Nov. 23, 2005 effective date of the Parent Case (11/288,064) is hereby claimed.

GOVERNMENT INTEREST

The invention described herein may be manufactured, used, imported, sold, and licensed by or for the Government of the United States of America without the payment of any royalty thereon or there for.

BACKGROUND OF THE INVENTION

1. Field of the Invention

The present invention relates generally to firearms and, more particularly, to guns for use in urban combat.

2. Related Art

During urban warfare, many times a warfighter may be faced with a situation in which, in taking a position for cover, the warfighter may be located immediately adjacent a building corner, a doorway corner or some other obstacle that blocks line of sight to a target. While imaging devices, such as scopes and the like, are flexible enough to be used to generate a suitable image of the target regardless of line of sight, a conventional firearm lacks an ability to be effectively fired at the target from behind the corner or obstacle without exposing a substantial portion of the warfighter's body to return fire.

One solution employed by warfighters is to, while standing adjacent a corner and holding a firearm in a ready to fire manner, rotate a conventional firearm such that a transverse axis of a gunstock of the gun is disposed generally parallel to the ground and then to extend the firearm around a corner while using a thumb to actuate the trigger. While this solution reduces the area of the warfighter's body to return fire, it has several disadvantages including that of reduced control over actuation of the trigger and over the recoil of the firearm.

SUMMARY OF THE INVENTION

In accordance with an embodiment of the present invention, a firearm comprises a barrel that has a central axis, a receiver fixedly supporting the barrel, a gunstock that is connected to the receiver and that comprises a longitudinal axis, and a shoulder stock extending in a plane that is generally perpendicular to the longitudinal axis of the gunstock. The gunstock and the receiver may each be configured to provide for angular movement of the gunstock relative to the receiver and, in turn, the barrel whereby the central axis of the barrel varies in a generally radial direction extending from the longitudinal axis of the gunstock. In this way, the firearm may be discharged by a warfighter, standing adjacent to a corner, around the corner.

BRIEF DESCRIPTION OF THE DRAWINGS

The following detailed description is made with reference to the accompanying drawings, in which:

FIG. 1(*b*) is a schematic diagram showing the firearm of FIG. 1(*a*) with the gunstock rotated with respect to a longitudinal axis of the barrel;

FIG. 2(*b*) is a side view of the gunstock of FIG. 1(*a*);

FIG. 3(*b*) is a schematic diagram, in cross section, showing actuation of the trigger assembly of FIG. 3(*a*) with the trigger depressed adjacent the gunstock;

FIG. 3(*c*) is a schematic diagram, showing the receiver of FIG. 1(*a*);

FIG. 4(*b*) is a schematic diagram showing the firearm of FIG. 4(*a*) with the gunstock and the fore grip rotated with respect to a longitudinal axis of the barrel;

FIG. 5(*b*) is a side view of the fore grip of FIG. 4(*a*);

FIG. 6(*b*) is a schematic diagram showing the firearm of FIG. 6(*a*) with the gunstock and shoulder stock rotated with respect to a longitudinal axis of the barrel;

FIG. 7(*b*) is a side view of the gunstock and shoulder stock of FIG. 6(*a*).

DETAILED DESCRIPTION OF THE PREFERRED EMBODIMENT

One embodiment of the present invention concerns a firearm which is configured to fire at a target from behind a corner or an obstacle without exposing a warfighter's body to return fire. More particularly, the firearm is configured such that it may be discharged along an axis at a relatively large angle to its conventional discharge axis, without requiring the warfighter who discharges the firearm, to be contorted while manipulating a trigger. In one particular embodiment, a fore grip and a gunstock including a trigger assembly may also be pivotal relative to the receiver thereof.

Figure 1A:
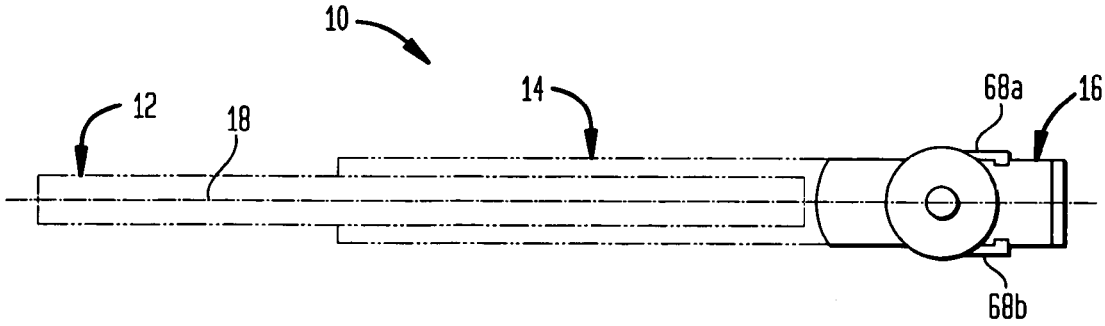
FIG. 1(*a*) is a schematic diagram showing a top view of a firearm having a gunstock, a receiver and a barrel in accordance with an embodiment of the present invention.
Figure 1B:
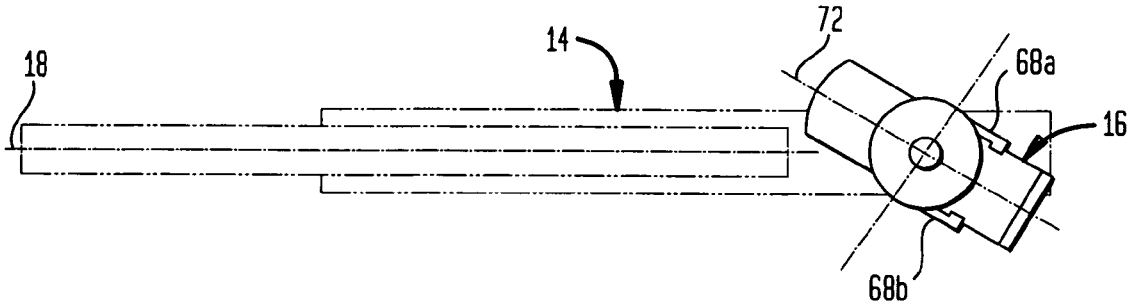

Referring now to FIGS. 1(*a*) and 1(*b*), a firearm, in accordance with one embodiment of the present invention, is illustrated generally at 10. In this embodiment, the firearm 10 comprises a barrel 12, a receiver 14 and a gunstock 16. The barrel 12 may be machined in a known manner from a suitably strong and durable material such as steel. The barrel 12 may be integrally connected to the receiver 14 as shown and comprises a central axis 18.

Figure 3B:
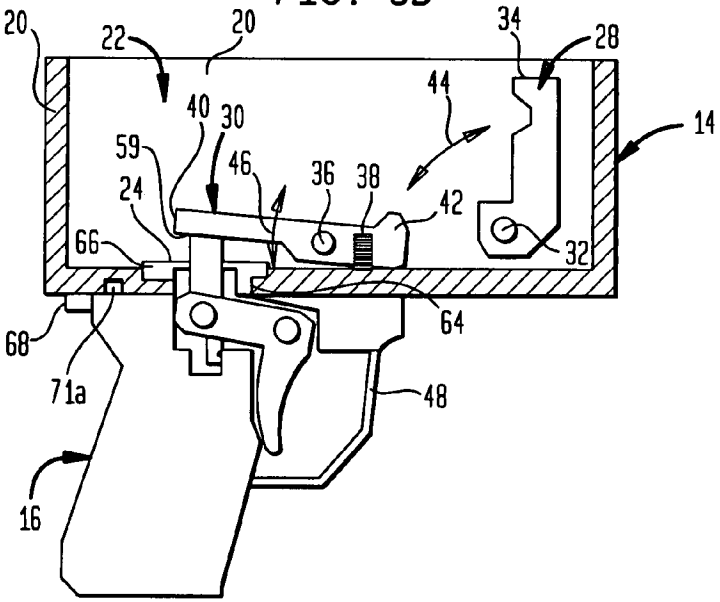
FIG. 3(*a*) is a schematic diagram, in cross section, showing the receiver and the gunstock, which comprises a trigger assembly and a trigger, of FIG. 1(*a*)
Figure 3C:
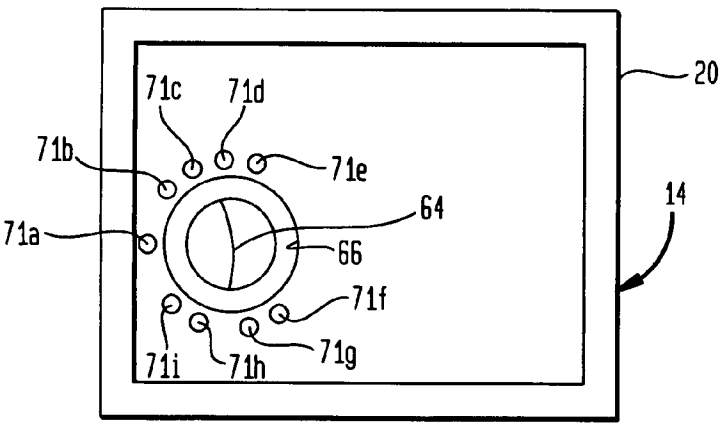
Figure 3A:
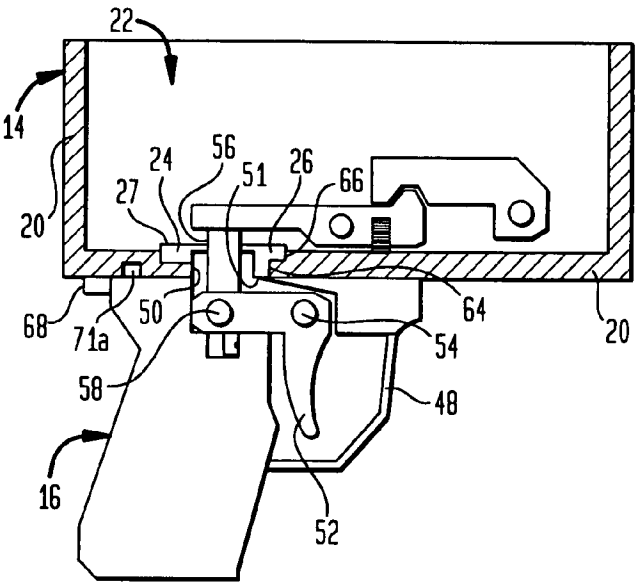

The receiver 14, which is best seen in FIGS. 3(*a*) and 3(*b*), may comprise a suitably strong material such as steel and also comprises walls 20 which define compartment 22 and an aperture 24. The aperture 24 comprises a shoulder portion 26 having a bearing surface 27.

Referring in particular to FIG. 3(*b*) for a moment, the receiver 14 may also comprise a hammer 28 and a sear 30. The hammer 28 is rotatably mounted to the receiver 14 via a pin 32 and has a grooved portion 34. The sear 30 is rotatably mounted to the receiver 14 via a pin 36 and is biased by a spring 38. The sear 30 may comprise an arm portion 40 and a catch portion 42 with the latter being configured to mate with the grooved portion 34 of the hammer 28. Arrows 44 and 46 make clear the rotational movement of the hammer 28 away from the sear 30 and rotation of the sear itself as evident from a comparison of FIG. 3(*a*) with FIG. 3(*b*).

The gunstock 16 may be composed of a similar material to that of the receiver 14 and comprises a trigger guard 48 and trigger assembly 50 located within a cavity 51. The trigger assembly 50 may comprise a trigger 52 which is rotatably mounted to the gunstock via a pin 54 and to a reciprocable member such as rod 56 via a pin 58. As can be seen in FIGS. 3(*a*) and 3(*b*), as the trigger 52 is pulled, the rod 56 pushes against a bearing surface 59 of the arm portion 40 of the sear 30, in turn, releasing the hammer 28.

Figure 2A:
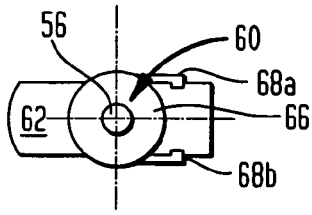
FIG. 2(*a*) is a top view of the gunstock of FIG. 1(*a*)
Figure 2B:
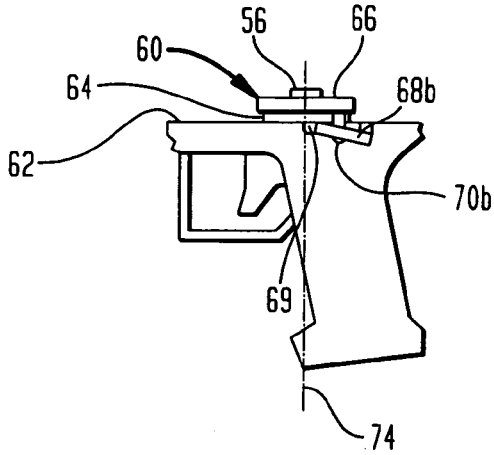

In accordance with the present embodiment, and as best seen in FIGS. 2(*a*) and 2(*b*), the gunstock 16 may comprise a member 60 that may be cylindrical in outer configuration and extends from a contact surface 62. The member 60 may comprise a body portion 64 and a head portion 66 that provides for a rotatable connection between the gunstock 16 and the receiver 14.

A pair of arms 68*a*, 68*b*, may be located on the gunstock 16 and may be engageable by a thumb of either a left handed or right handed warfighter (not shown), to provide for releasable movement of the gunstock 16 relative to the receiver 14. The arms 68*a*, 68*b* may each extend from opposing ends of a rotatable rod 69. Referring to FIGS. 2(*b*) 3(*a*) and 3(*c*), a reciprocable pin 70*b* may be moved by the arm 68*b* and may be reciprocated into and out of a plurality of bores 71*a*-71*i* through movement of either of the arms 68*a*, 68*b* and rotation of the receiver 14 relative to the gunstock 16, as described below. Another reciprocable pin (not shown) may be connected to the arm 68*a* and function similar to the reciprocable pin 70*b*.

Referring again to FIGS. 3(*a*) and 3(*b*), the receiver 14 may be assembled with the gunstock 16 such that the body portion 64 and the head portion 66 of the member 60 engage the aperture 24 and shoulder 26, respectively, of the receiver. In this way, the body portion 64 is rotatable within the aperture 24 while the head portion 66 is supported by, and slideably rotatable against, the shoulder 26.

In operation and as shown in FIGS. 1(*a*) and 1(*b*), after release of the arms 68*a*, 68*b*, the gunstock 16 may be rotated with respect to the receiver 14 and barrel 12 whereby an axis 72 of the gunstock, that is transverse to a longitudinal axis 74 (FIG. 2(*b*)) of the gunstock, may be disposed at an acute angle to the central axis 18 of the barrel 12.

Figure 4A:
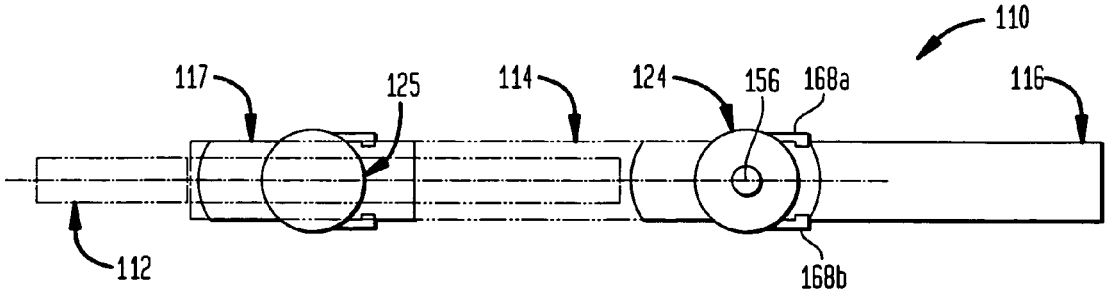
FIG. 4(*a*) is a schematic diagram showing a top view of a firearm having a gunstock, a receiver, a barrel and a fore grip in accordance with another embodiment of the present invention.
Figure 4B:
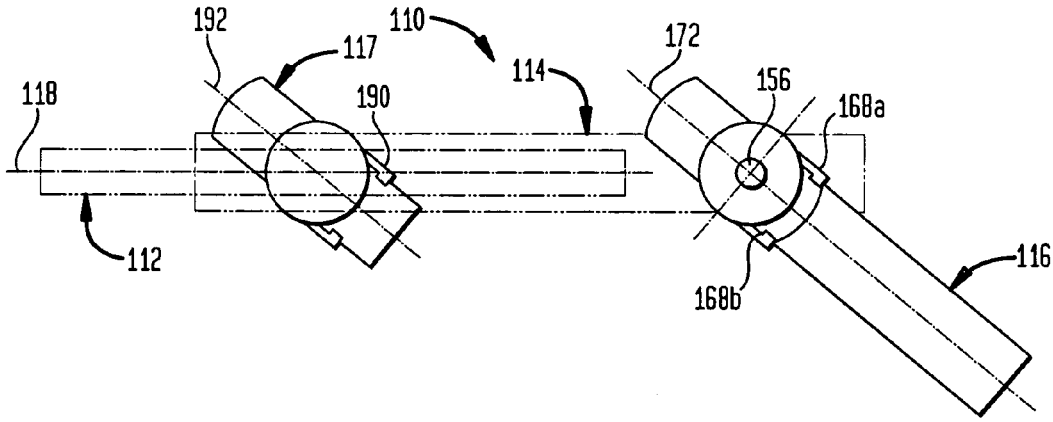

In accordance with another embodiment of the present invention, and with reference to FIG. 4(*a*), a firearm is shown generally at 110. The firearm 110 may be similar to the firearm 10 described above and, as such, similar elements are referred to with like reference numbers excepting that a one proceeds the reference number. In this embodiment, the firearm 110 comprises a barrel 112, a receiver 114, a gunstock 116 and a fore grip 117. The barrel 112 and gunstock 116 may be similar to those described above in all aspects, excepting that it will be understood that each may vary in dimensional parameters as the firearm 10 is illustrated as a handgun while the firearm 110 is illustrated as a rifle.

The receiver 114 may comprise a similar material to that of the receiver 14, described above, and comprises an aperture 124, although, the receiver 114 also comprises a second aperture 125 for rotational connection with the fore grip 117.

Figure 5A:
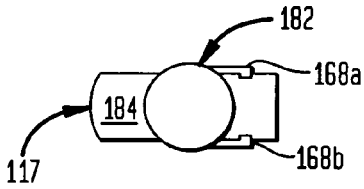
FIG. 5(*a*) is a top view of the fore grip of FIG. 4(*a*)
Figure 5B:
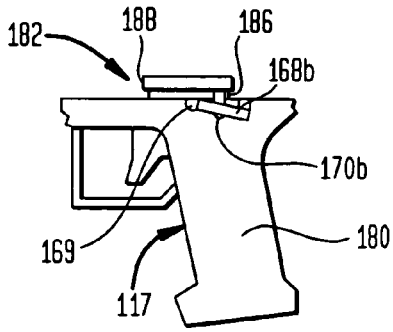

The fore grip 117 is best seen in FIGS. 5(*a*) and 5(*b*) and may comprise a similar material to that of the gunstock 16. The fore grip 117 may comprise a grip portion 180 and a member 182 that, may be similar to the member 60 and as such, may be cylindrical in outer configuration and extends from a contact surface 184. The member 180 may comprise a body portion 186 and a head portion 188. A pair of arms 168*a*, 168*b*, similar to arms 68*a*, 68*b* and, engageable by a thumb of either a left handed or right handed warfighter (not shown), may be provided for releasing the gunstock 116 for movement relative to the receiver 114. Also similar to the arms 68*a*, 68*b*, the arms 168*a*, 168*b* may each extend from opposing ends of a rotatable rod 169 and a reciprocable pin 170*b* may be moved by the arm 168*b* into and out of a plurality of bores (similar to those shown in FIG. 3(*c*)) of the receiver 114 through movement of either of the arms 168*a*, 168*b* and rotation of the receiver relative to the gunstock 116, as described below.

In operation and as shown in FIGS. 4(*a*) and 4(*b*), after release of the arms 168*a*, 168*b*, the gunstock 116 may be rotated with respect to the receiver 114 and barrel 112 whereby an axis 172 of the gunstock, may be disposed at an acute angle to a central axis 118 of the barrel. Similarly, after release of the arm 190, the fore grip 117 may be rotated with respect to the barrel 112 whereby an axis 192 of the fore grip also may be disposed at an acute angle to the central axis 118. In this way, a warfighter (not shown) may discharge the firearm 110 around a corner (also not shown).

Figure 6A:
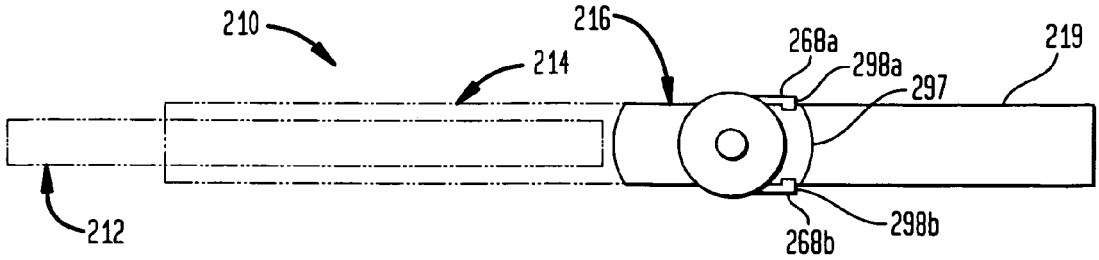
FIG. 6(*a*) is a schematic diagram showing a top view of a firearm having a gunstock, a receiver, a barrel and a shoulder stock in accordance with another embodiment of the present invention.
Figure 6B:
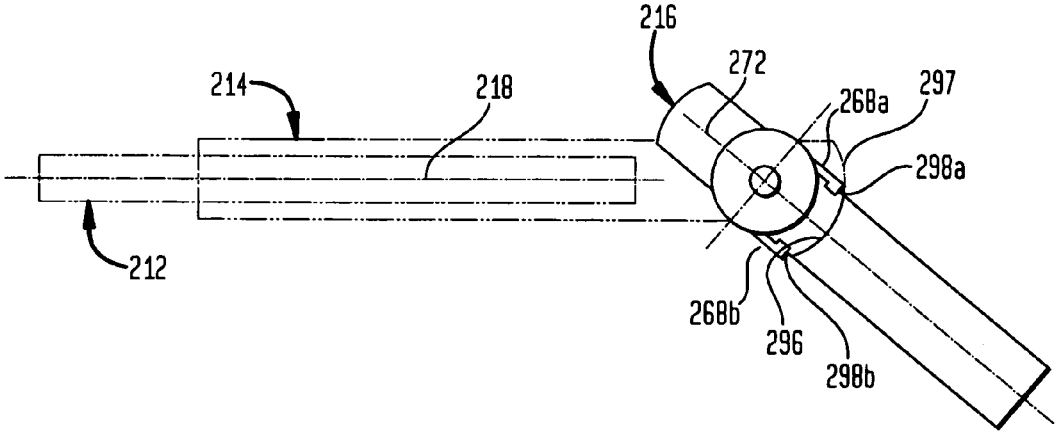

In accordance with a further embodiment of the present invention and now referring to FIG. 6(*a*), a firearm is illustrated generally at 210. The firearm 210 may be similar to the firearm 10 and the firearm 110 described above and, as such, similar elements are referred to with like reference numbers excepting that a two proceeds the reference number. In this embodiment, the firearm 210 comprises a barrel 212, a receiver 214, a gunstock 216 and a shoulder stock 219. Each of the barrel 212 and receiver 214 may be similar to those described above in all aspects to either barrel 12, 112 and either receiver 14, 114 excepting that it will be understood that each may vary in dimensional parameters.

Figure 7A:
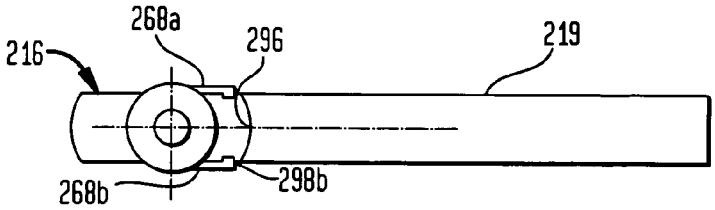
FIG. 7(*a*) is a top view of the gunstock and shoulder stock of FIG. 6(*a*)
Figure 7B:
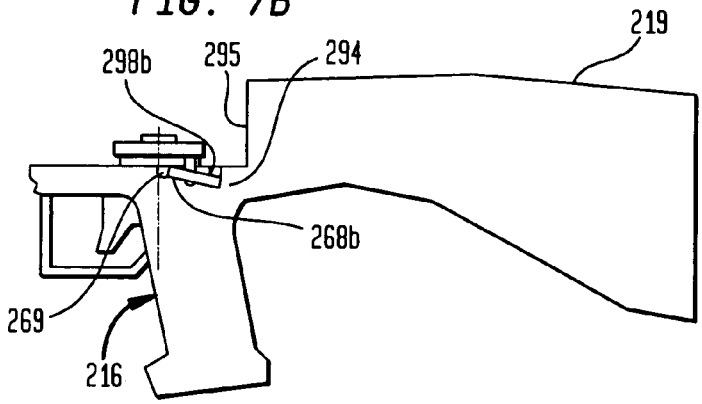

Referring now also to FIGS. 7(*a*) and 7(*b*), the gunstock 216 may comprise a similar material to that of either of the gunstocks 16 or 116 described above and is connected to the shoulder stock 219 at a neck portion 294. The shoulder stock 219 may comprise an end 295 which comprises an arcuate surface 296 that may correspond with an arcuate surface 297 of the receiver 214 for smooth slideable contact therebetween.

A pair of arms 268*a*, 268*b*, similar to arms 68*a*, 68*b* and, engageable by a thumb of either a left handed or right handed warfighter (not shown), may be provided for releasing the gunstock 216 for movement relative to the receiver 214. Also similar to the arms 68*a*, 68*b*, the arms 168*a*, 168*b* may each extend from opposing ends of a rotatable rod 269 and each may comprise a protrusion 298*a*, 298*b* into and out of a plurality of bores (similar to those shown in FIG. 3(*c*)) of the receiver 214 through movement of either of the arms 268*a*, 268*b* and rotation of the receiver relative to the gunstock 216, as described below.

Operation of the firearm 210 is similar to that of the firearm 10 described above and as shown in FIGS. 6(*a*) and 6(*b*), after release of the arms 268*a*, 268*b*, the gunstock 216 may be rotated with respect to the receiver 214 and barrel 212 whereby an axis 272 of the gunstock, may be disposed at an acute angle to a central axis 218 of the barrel. In this way, a warfighter (not shown) may discharge the firearm 210 around a corner (also not shown).

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. A firearm with a rotatable grip, comprising:

a barrel having a central axis;

a receiver fixedly supporting the barrel;

a gunstock connected to the receiver provides a longitudinal axis;

a shoulder stock extending in a plane that is generally perpendicular to the longitudinal axis of the gunstock;

the gunstock and the receiver each being configured to provide for angular movement of the gunstock relative to the receiver and, in turn, the barrel whereby the central axis varies in a generally radial direction extending from the longitudinal axis of the gunstock allowing the firearm to be discharged around a corner by a user standing adjacent to the corner;

the gunstock having a gunstock connector joint, being configured to rotatably engage with the receiver and a cavity, having a gunstock cylindrical member extending from the gunstock that is dimensioned to mate with a correspondingly configured aperture located on the receiver;

the rotatable fore grip having a grip portion, a member having a body portion and a head portion and a pair of arms that can be engaged by a thumb that allows releasing the gunstock for movement of the rotatable fore grip relative to the receiver;

the aperture of the receiver having a shoulder portion and a shoulder portion bearing surface whereagainst the head portion is supported and rotatable;

the gunstock cylindrical member having a bore communicating with the cavity and the receiver; and the receiver having a compartment communicating with the bore and further comprising a trigger assembly extending through the cavity, the bore and the compartment.

2. The firearm with the rotatable fore grip of claim 1, wherein the trigger assembly comprises:

a trigger pivotably mounted within a cavity of the gunstock that communicates with the bore of the gunstock cylindrical member, a reciprocable member pivotably connected to the trigger and extending through the bore of the gunstock cylindrical member;

a sear slidingly engaging the reciprocable member and being pivotably mounted within the compartment of the receiver;

a sear spring located in the compartment of the receiver and configured to exert a bias force against the sear; and a hammer pivotably mounted in the compartment of the receiver and configured to releasably engage the sear.

3. The firearm with the rotatable fore grip of claim 2, wherein the reciprocable member comprises a rod which has a free end and the hammer comprises an arm having an arm bearing surface which is dimensioned and configured to engage the free end of the rod during the angular movement of the gunstock relative to the barrel.

4. The firearm with the rotatable fore grip of claim 3, wherein the sear comprises a groove portion and the hammer comprises a catch portion that is correspondingly configured to the groove portion to provide the releasable engagement between the sear and the hammer.

5. The firearm with the rotatable fore grip of claim 1, wherein the shoulder stock comprises a neck portion for connecting to the gunstock and an arcuate surface that corresponds with an arcuate surface of the receiver for slideable contact therewith.

6. A firearm, comprising:

a barrel having a central axis;

a receiver fixedly supporting the barrel;

a gunstock connected to the receiver provides a longitudinal axis;

a shoulder stock extending in a plane that is generally perpendicular to the longitudinal axis of the gunstock;

the gunstock and the receiver each being configured to provide for angular movement of the gunstock relative to the receiver and, in turn, the barrel whereby the central axis varies in a generally radial direction extending from the longitudinal axis of the gunstock allowing the firearm to be discharged around a corner by a user standing adjacent to the corner; and the gunstock further comprises at least one arm configured to engage and lock the gunstock with the receiver at various angles wherein each of the at least one arms comprises a pair of arms each being affixed at one end thereof to a connecting rod extending through the gunstock and each comprising a protrusion.

7. The firearm of claim 6, wherein the receiver comprises a plurality of bores that are arranged in an arcuate pattern and are dimensioned and configured to receive each respective protrusion from each arm during movement of the receiver relative to the gunstock.

* * * * *

UNITED STATES PATENT AND TRADEMARK OFFICE

CERTIFICATE OF CORRECTION

PATENT NO. : 7,322,141 B1
APPLICATION NO. : 11/288067
DATED : January 29, 2008
INVENTOR(S) : Fee Chan Leung It is certified that error appears in the above-identified patent and that said Letters Patent is hereby corrected as shown below:

Column 5, Claim 1, line 1:

Insert --fore-- before the word "grip".

Signed and Sealed this

Sixth Day of May, 2008

JON W. DUDAS
*Director of the United States Patent and Trademark Office*